US008152280B2

(12) United States Patent
Keenan et al.

(10) Patent No.: US 8,152,280 B2
(45) Date of Patent: Apr. 10, 2012

(54) METHOD OF MAKING AN INKJET PRINTHEAD

(75) Inventors: Phil Keenan, Dublin (IE); Pat MacDermott, Kildare (IE); Kevin Dooley, Wicklow (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 1781 days.

(21) Appl. No.: 11/042,166

(22) Filed: Jan. 26, 2005

(65) Prior Publication Data

US 2005/0179735 A1 Aug. 18, 2005

(30) Foreign Application Priority Data

Jan. 29, 2004 (GB) ..... 0401869.3

(51) Int. Cl.
*B41J 2/045* (2006.01)
*B41J 2/04* (2006.01)

(52) U.S. Cl. ..... 347/68; 347/54

(58) Field of Classification Search ..... 347/68, 347/54

See application file for complete search history.

(56) References Cited

U.S. PATENT DOCUMENTS

| | | | | |
|---|---|---|---|---|
| 5,761,783 | A * | 6/1998 | Osawa et al. | 29/25.35 |
| 6,027,207 | A * | 2/2000 | Reinten et al. | 347/68 |
| 6,362,844 | B1 | 3/2002 | Shieh et al. | |
| 6,543,880 | B1 * | 4/2003 | Akhavain et al. | 347/42 |
| 6,568,797 | B2 * | 5/2003 | Yamauchi et al. | 347/70 |
| 6,766,817 | B2 | 7/2004 | Da Silva | |
| 2002/0027576 | A1 * | 3/2002 | Yamanaka et al. | 347/54 |
| 2002/0044171 | A1 * | 4/2002 | Hirahara et al. | 347/46 |

FOREIGN PATENT DOCUMENTS

| | | |
|---|---|---|
| GB | 2157232 A | 10/1985 |
| JP | 10-128976 | 5/1998 |
| JP | 11-157071 | 6/1999 |

* cited by examiner

*Primary Examiner* — Stephen Meier
*Assistant Examiner* — Sarah Al Hashimi

(57) ABSTRACT

A hardwearing inkjet printhead comprises a substrate 10 having an ink ejection circuit 12 and a patterned glass frit planarization layer 22 on its surface. A ceramic body 28 has a substantially flat surface 28B intimately bonded to the planarization layer. The ceramic body and planarization layer together define at least one ink ejection chamber 18 and associated ink ejection nozzle 38 with the nozzle and at least the major part of the height of the chamber formed in the ceramic body.

11 Claims, 8 Drawing Sheets

METHOD OF MAKING AN INKJET PRINTHEAD

TECHNICAL FIELD

This invention relates to a method of making an inkjet printhead.

BACKGROUND ART

Conventional inkjet printers typically operate by ejecting small droplets of ink from individual orifices in an array of such orifices provided on a nozzle plate of a printhead. The printhead may form part of a print cartridge which can be moved relative to a sheet of paper and the timed ejection of droplets from particular orifices as the printhead and paper are relatively moved enables characters, images and other graphical material to be printed on the paper.

A simplified plan view of a typical conventional printhead is shown in FIG. 1. It is fabricated on a silicon substrate 10 having thin film resistors 12 and associated thin film circuitry (not shown) deposited on its front surface (i.e. the surface facing the viewer in FIG. 1). The resistors 12 are arranged in an array relative to one or more ink supply slots 14 in the substrate, and a barrier material 16 is formed on the substrate around the resistors to isolate each resistor inside a respective thermal ejection chamber 18. The barrier material 16 is shaped both to form the thermal ejection chambers 18 and to provide an ink communication channel 20 between each chamber 18 and the ink supply slot 14. In this way, the thermal ejection chambers 18 are filled by capillary action with ink from the ink supply slot 14, which itself is supplied with ink from an ink reservoir in the print cartridge of which the printhead forms part.

The composite assembly described above is typically capped by a nozzle plate, for example of nickel or polyimide, which is not shown in FIG. 1 to avoid obscuring the underlying detail. The nozzle plate has an array of orifices which correspond to and overlie the ejection chambers 18 so that each orifice is in register with a respective resistor 12. The printhead is thus sealed by the nozzle plate, but permits ink flow from the print cartridge via the orifices in the nozzle plate.

The printhead operates under the control of printer control circuitry which is configured to energise individual resistors according to the desired pattern to be printed. When a resistor is energised it quickly heats up and superheats a small amount of the adjacent ink in the thermal ejection chamber. The superheated volume of ink expands due to explosive evaporation and this causes a droplet of ink above the expanding superheated ink to be ejected from the chamber via the associated orifice in the nozzle plate.

FIG. 1 shows a printhead where a series of thin film heating resistors 12, and corresponding nozzles, are disposed along each side of a single ink supply slot 14. However, many variations on this basic construction will be well known to the skilled person. For example, a number of arrays of orifices and chambers may be provided on a given printhead, each array being in communication with a different coloured ink reservoir. The configurations of the ink supply slots, thin film circuitry, barrier material and nozzle plate are open to many variations, as are the materials from which they are made and the manner of their manufacture.

The typical printhead described above is normally manufactured simultaneously with many similar such printheads on a large area silicon wafer which is only divided up into individual printhead dies at a late stage in the manufacture.

Existing printhead technology is not suitable for newly-emerging industrial applications in which it is desired to print using "ink" comprising suspensions of, for example, ceramic particles in strong solvents and acid bases. Thus, printheads made using photoresist as the barrier material are not resistant to chemicals such as acids, bases, etc. or the presence of solvents such as toluene, and tend to delaminate from the die or the nozzle plate and fail soon after operation. Printheads made using a polyimide orifice plate are not durable to the jetting of ceramic materials as these hard particle will cause rapid wear in the soft nozzle material resulting in continuously increasing drop weight and increases in drop misdirection. Soft nozzle materials are also prone to scratching in use, another cause of misdirection.

There is therefore an emerging needs for industrial print heads that are resistant to attack from acids/alkalis/solvents and that have good mechanical abrasion/wear resistance to allow thermal inkjets to be used for new applications such as the precise deposition of functional materials, e.g. liquids intended to form conductors and resistors in miniature electrical circuits.

It is an object of the invention to provide an improved method of making an inkjet printhead in which, at least in certain embodiments, these needs are met.

DISCLOSURE OF THE INVENTION

The invention provides an inkjet printhead comprising a substrate, an ink ejection circuit on a surface of the substrate, a patterned planarization layer on the surface of the substrate, and a ceramic body having a substantially flat surface intimately bonded to the planarization layer, the ceramic body and planarization layer together defining at least one ink ejection chamber and associated ink ejection nozzle with the nozzle and at least the major part of the height of the chamber formed in the ceramic body.

Preferably the ceramic body is a monolithic layer and most preferably comprises silicon carbide, silicon nitride, yttria-modified zirconia or alumina.

The invention further provides a method of making an inkjet printhead comprising forming an ink ejection circuit on a surface of a substrate, forming a patterned planarization layer on the surface of the substrate, and intimately bonding a substantially flat surface of a ceramic body to the planarization layer, the ceramic body and planarization layer together defining at least one ink ejection chamber and associated ink ejection nozzle with the nozzle and at least the major part of the height of the chamber formed in the ceramic body.

According to an embodiment of the invention, the ceramic body is formed by attaching one surface of a ceramic layer to a first temporary substrate, selectively etching the opposite surface of the ceramic layer to form at least one blind nozzle, attaching the said opposite surface of the ceramic layer to a second temporary substrate, removing the first temporary substrate, and selectively etching the said one surface of the ceramic layer to form at least one ink jet chamber communicating with the nozzle, the said one surface being the surface which is intimately bonded to the planarization layer.

As used herein, the terms "inkjet", "ink supply slot" and related terms are not to be construed as limiting the invention to devices in which the liquid to be ejected is an ink. The terminology is shorthand for this general technology for printing liquids on surfaces by thermal, piezo or other ejection from a printhead, and while one application is the printing of ink, the invention will also be applicable to printheads which deposit other liquids in like manner, for example, liquids intended to form conductors and resistors in miniature electrical circuits.

Furthermore, the method steps as set out herein and in the claims need not necessarily be carried out in the order stated, unless implied by necessity.

BRIEF DESCRIPTION OF THE DRAWINGS

In the drawings, which are not to scale, the same parts have been given the same reference numerals in the various figures.

DESCRIPTION OF PREFERRED EMBODIMENT

Figure 2:
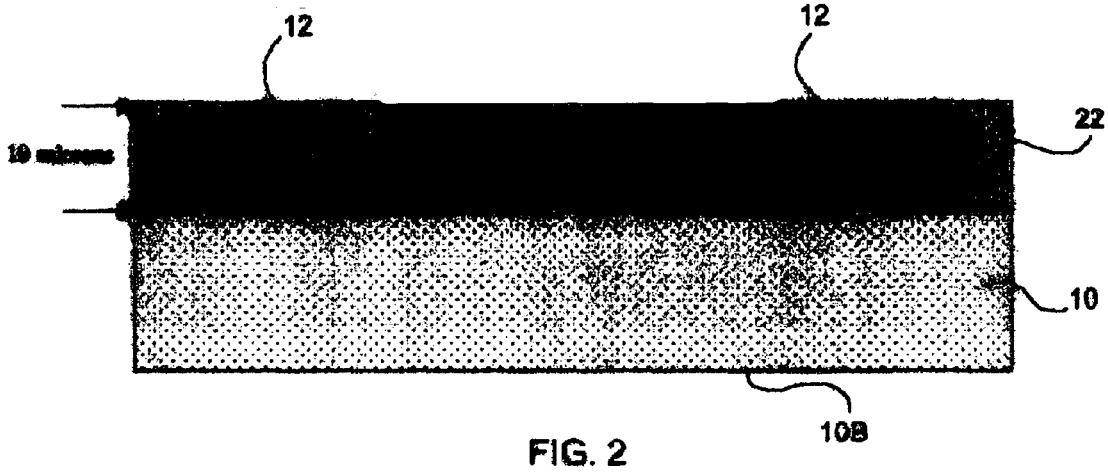
FIGS. 2 to 15 show successive steps in making a printhead according to the embodiment of the invention.
Figure 3:
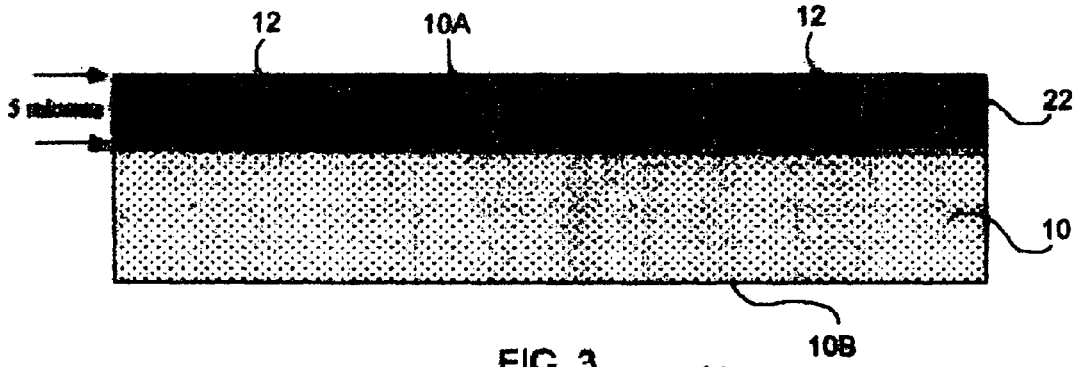

FIG. 2 shows, in cross-sectional side view, a substantially circular silicon wafer 10 of the kind typically used in the manufacture of conventional inkjet printheads. In this embodiment the wafer 10 has a thickness of 675 μm and a diameter of 150 mm. The wafer 10 has opposite, substantially parallel front and rear major surfaces 10A and 10B respectively, the front surface 10A being flat, highly polished and free of contaminants in order to allow ink ejection elements to be built up thereon by the selective application of various layers of materials in known manner.

Figure 1:
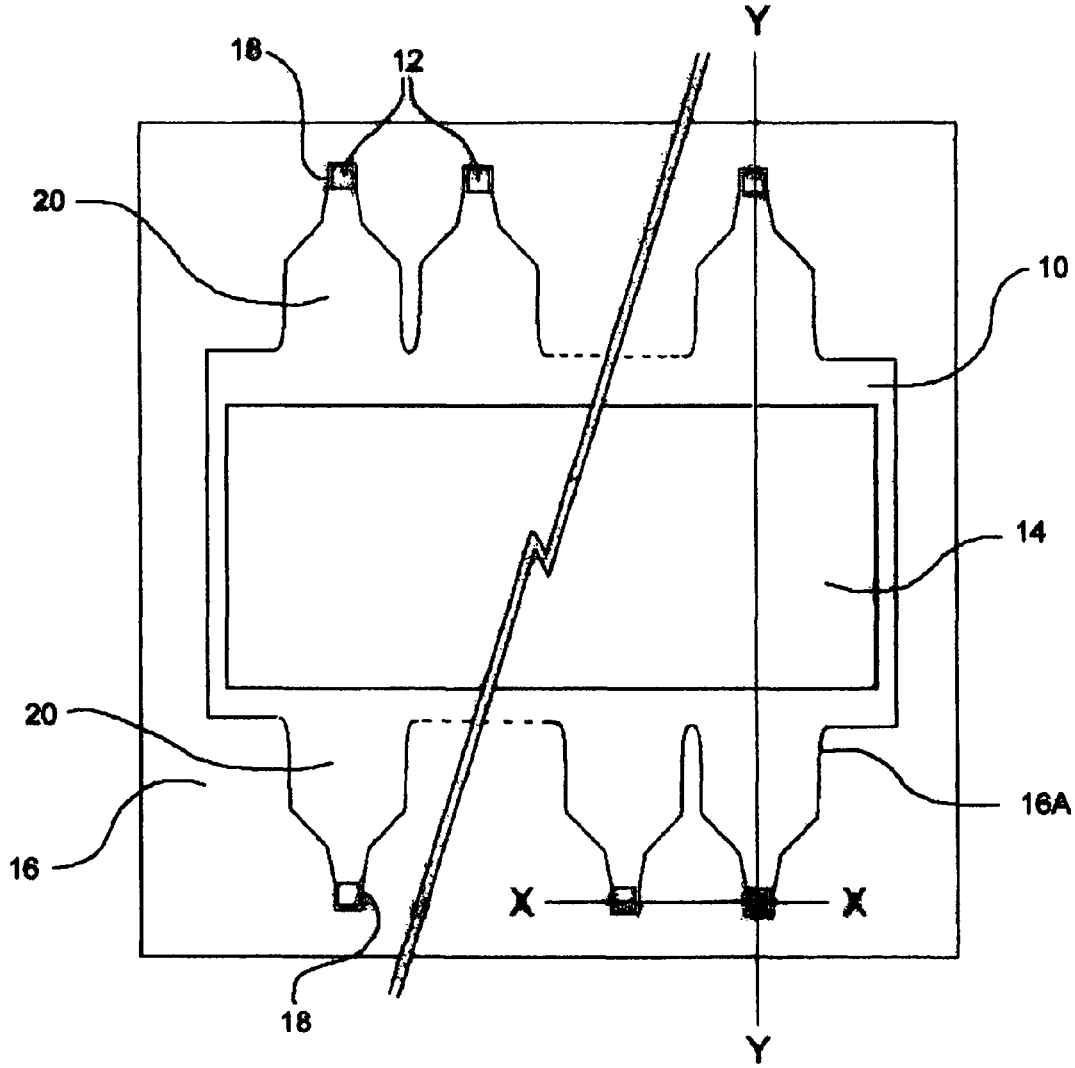
FIG. 1 is a simplified plan view of a printhead.
Figure 14:
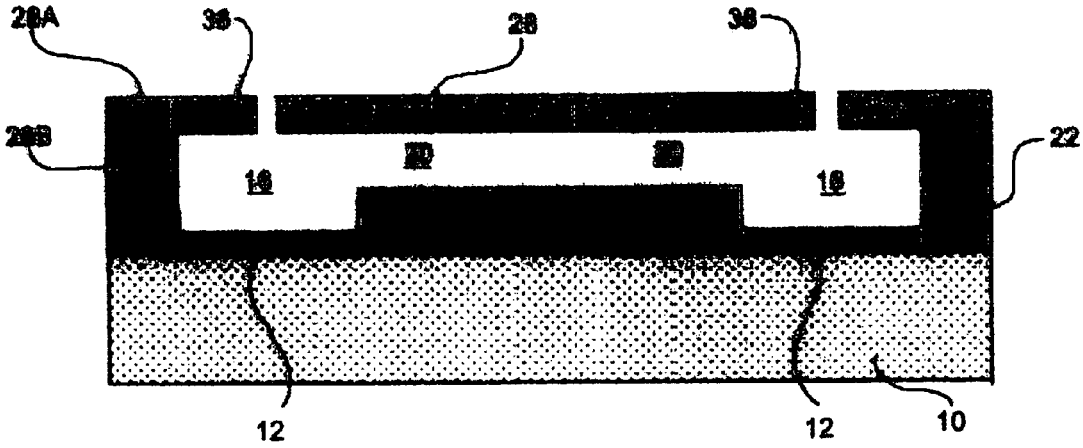
Figure 15:
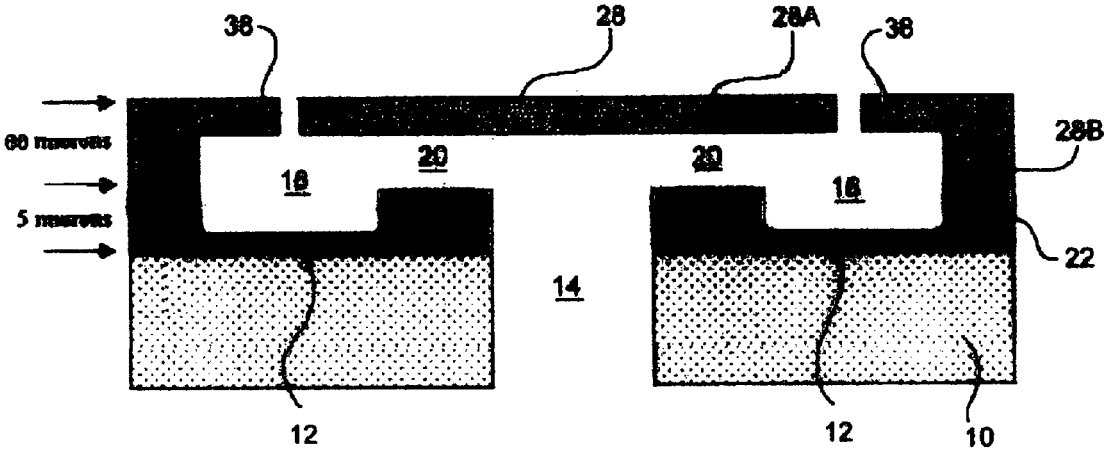

It will be understood that FIGS. 2 to 15 show only a fragmentary part of the wafer. The printhead according to the present embodiment of the invention may have the same geometric plan view as the printhead shown in FIG. 1, so in FIGS. 2 to 13 only the portion of the wafer corresponding to a cross-section taken on X-X of FIG. 1 is shown, while FIGS. 14 and 15 show the portion of the wafer corresponding to a cross-section taken on Y-Y of FIG. 1. In practice, of course, a large number of complete printheads will be processed simultaneously on the undivided wafer and the latter only divided into individual printhead dies at a late stage in the manufacture.

The first step in the manufacture of a printhead according to the embodiment of the invention is to process the front surface 10A of the wafer in conventional manner to lay down thin film ink ejection circuitry of which, for the sake of avoiding overcomplicating the drawings, only the thin film heating resistors 12 are shown. These resistors 12, in the embodiment, are connected via conductive traces to a series of contacts which are used to connect the traces via flex beams with corresponding traces on a flexible printhead-carrying circuit member (not shown) mounted on a print cartridge. The flexible printhead-carrying circuit member enables printer control circuitry located within the printer to selectively energise individual resistors under the control of software in known manner. As discussed, when a resistor 12 is energised it quickly heats up and superheats a small amount of the adjacent ink which expands due to explosive evaporation.

Now that the thin film ink ejection circuitry, exemplified by the resistors 12, has been deposited, the front surface 10A of the wafer 10 is no longer flat. As will be described, it is desired to bond to the wafer 10 a flat surface of a hard, non-conforming ceramic wafer containing nozzles and ink ejection chamber walls. Therefore, it is necessary to provide the wafer 10 with a corresponding hard flat surface which can be intimately bonded to the flat surface of the ceramic wafer.

In the present embodiment this is achieved using a glass frit. Glass frits are used in the semiconductor industry for wafer bonding and encapsulation and can be applied as a slurry with organic binders to wafers by low cost methods such as spin-coating, drying and baking. After baking, the glass frit can be polished mirror-flat.

Accordingly, a slurry of a low-melting point glass frit 22, such as EG2020 in alpha terpineol supplied by Ferro Corporation, is spin-coated onto the surface 10A to form a layer 10 microns thick. The coating is heated in air at 125 deg. C. to drive off the alpha terpineol and then heated further to 200 deg. C. to remove the binder. The coating is then glazed by heating at 390 deg. C. for 15 minutes. This fuses the glass frit and reduces its porosity.

The exposed surface of the fused glass frit layer 22 is now made smooth and flat by grinding and polishing using, for example, a G&N Grind Polisher. Approximately 5 microns of glass frit is removed in the process to achieve the desired surface flatness, FIG. 3.

Figure 4:
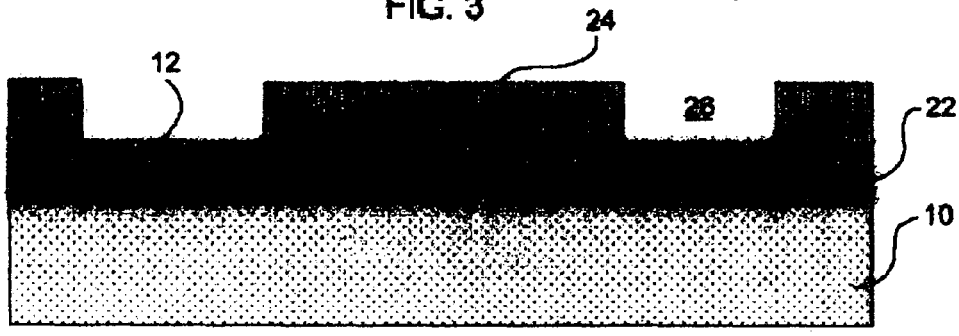

The polished surface of the glass frit layer 22 is next coated with a blanket layer of photoresist 24 which is selectively exposed through a photomask and developed. The result is shown in FIG. 4 where the now patterned photoresist layer 24 has openings 26 which define the lateral boundaries of a plurality of ink ejection chambers 18, FIG. 4. The regions of the glass frit layer 22 exposed in the openings 26 are now etched away in a hydrofluoric acid bath to remove the frit from over the thin film circuitry and wafer surface 10A in those regions. The photoresist 24 is then stripped from the wafer 10, FIG. 5.

As this embodiment of printhead is designed for industrial printing applications exposing the printhead to abrasive particles and aggressive solvents, the chambers 18 and ink ejection nozzles are fabricated in a hard ceramic material.

Accordingly, in the present embodiment a flat and smooth silicon carbide ceramic wafer 28 is mounted onto a heat release tape 30 (e.g. Revalpha thermal release tape manufactured by Nitto Denko) and attached to a blank silicon backing wafer 32 or other rigid substrate. The silicon carbide wafer is ground back to leave a 60 micron thick layer, FIG. 6. The exposed surface 28A of the silicon carbide layer 28 is then coated with a blanket layer of a photoresist 34 which is selectively exposed through a photomask and developed to expose nozzle regions 36 of the silicon carbide surface 28A, FIG. 7. The silicon carbide is then selectively etched in the regions 36 by reactive ion etching using $SF_6$ to create the nozzles 38 as blind vias, i.e. the nozzles 38 do not quite break through to the opposite surface 28B of the silicon carbide layer, following which the photoresist 34 is removed, FIG. 8.

The exposed surface 28A of the silicon carbide layer 28 containing the blind nozzles 38 is now taped onto a second rigid backing wafer 40 using a thermal release tape 42 having a higher release temperature than the thermal release tape 30. Alternatively, it can be attached to a transparent backing wafer using UV release tape. In any event, the first backing wafer 32 is now release with heat, and in doing so the opposite surface 28B of the silicon carbide layer is thus exposed for subsequent processing, FIG. 9.

Figure 10:
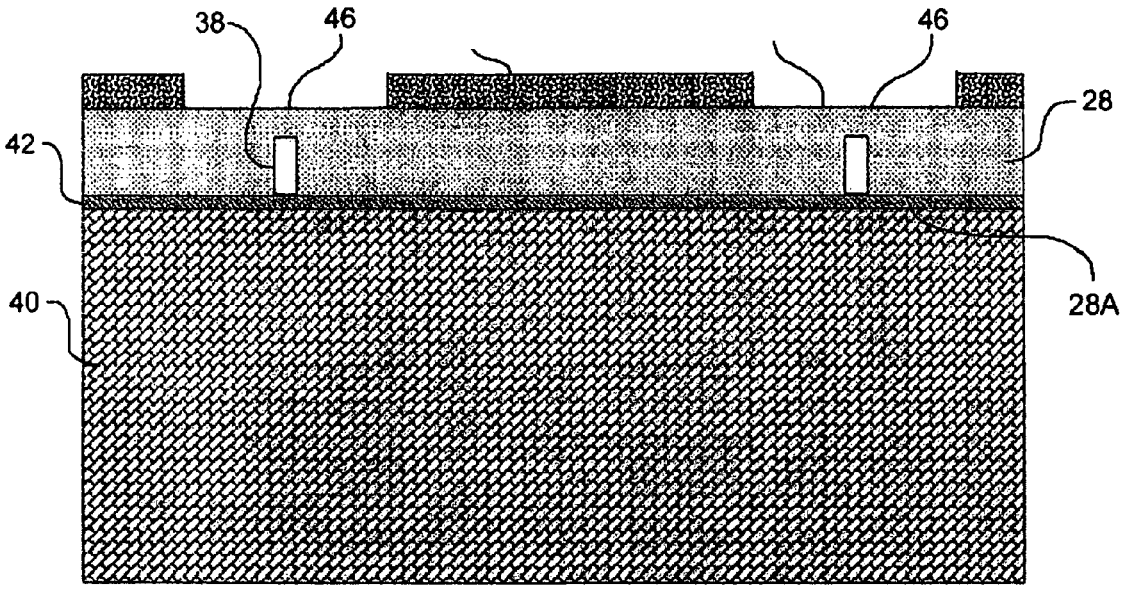
Figure 11:
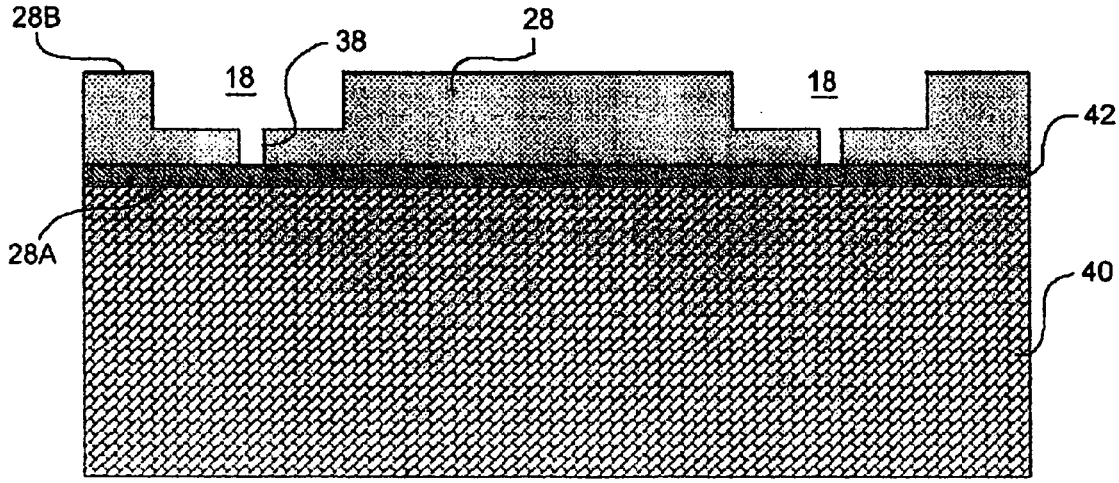

The surface 28B of the silicon carbide layer is now blanket coated with photoresist 44 which is selectively exposed through a photomask and developed to expose regions 46 of the silicon carbide 28 which define the lateral boundaries of both the ink ejection chambers 18 and the ink communication channels 20, FIG. 10. Effectively, the photomask used at this stage of the process corresponds to the internal periphery 16A of the barrier material 16 shown in FIG. 1.

Again the silicon carbide 28 is reactive ion etched using $SF_6$ through the photoresist 44 to create the ink ejection chambers 18 and the ink communication channels 20. At this point the plasma etch breaks through to make a through interconnection with the nozzles 38. After etch, the photoresist 44 is stripped away, FIG. 11.

It will be appreciated that the reason for blind etching the nozzles 38 into one surface 28A of the silicon carbide layer 28 and then inverting the layer to etch the chambers 18 and channels 20 into the opposite surface 28B is that it allows each photoresist layer 34, 44 to be spun onto an uninterrupted planar surface of the silicon carbide layer 28. As an alternative, to allow both etch steps to be made into the same surface 28A of the silicon layer 28, it is possible to etch the nozzles 38 completely through the layer 28 in the first etch and then temporarily fill the nozzles with, for example, a wax to planarize the surface 28A for receipt of the second photoresist layer. Another possibility is to use a dry photoresist layer for the second etch.

Figure 12:
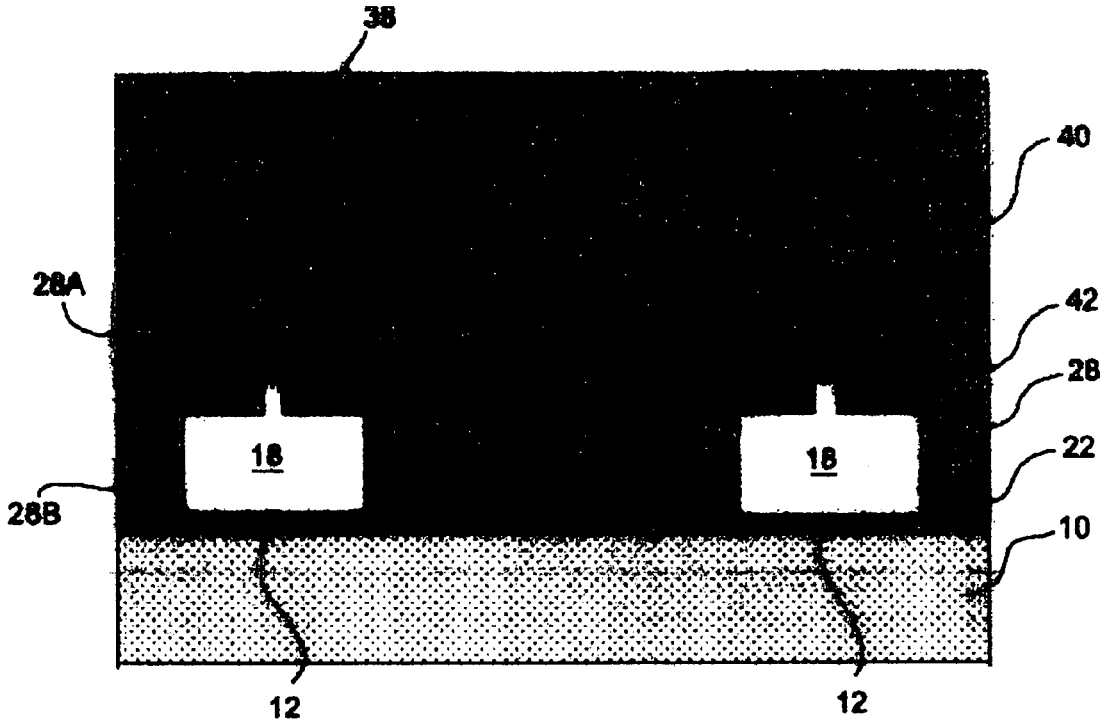
Figure 13:
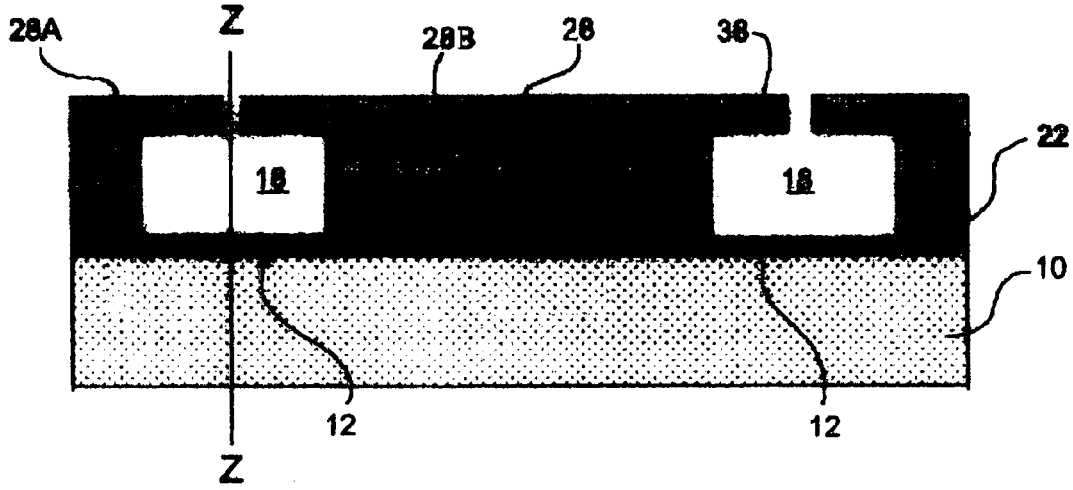

Now, FIG. 12, the silicon carbide layer 28 on the backing wafer 40 is brought into face-to-face contact with the patterned glass frit layer 22 on the silicon wafer 10 such that the ejection chambers 18 in the layer 28 are in precise registration with the corresponding regions of the glass frit layer 22, FIG. 12. This is done using a wafer aligner that can align fiducial marks on inward facing wafers, such as an EV Group 620 alignment tool. The EV 620 alignment tool has two sets of pre-aligned lenses and cameras for aligning top and bottom wafers to be bonded. The left and right top cameras are accurately aligned to the left and right bottom cameras. Firstly the bottom wafer is introduced to the camera region with its alignment targets facing upwards and the alignment targets aligned to the left and right top cameras. The bottom wafer's alignment position is then recorded from the wafer's stage encoders and the wafer is then entirely withdrawn from the alignment region. The top wafer is now introduced to the alignment region with its alignment targets facing downwards. The wafer is then aligned to the left and right bottom cameras. Finally the bottom wafer is re-introduced to the alignment region and moved to its previously recorded alignment coordinates. Thus both the bottom wafer is accurately aligned to the top wafer. The top wafer is then lowered until it is in contact with the bottom wafer and the two wafers then clipped together to retain alignment while the wafer pair is transferred to a bonding tool. Using this alignment tool the two wafers 10, 40 can be aligned to +/−1.0 microns.

The wafers thus aligned and clipped together are transferred to a bonding tool such as an EV Group EV G 850 wafer fusion bonder. The glass frit and silicon carbide layers 22, 28 are then intimately bonded together at 390 deg. C. for 15 minutes. After bonding, the backing wafer 40 is removed by heating the release tape 42, FIG. 13. FIG. 14 is a cross-sectional view of the wafer 10 at the same stage of processing as FIG. 13, but taken on the line Z-Z of FIG. 13 (Y-Y in FIG. 1).

The wafer 10 is now blind trenched from below using a laser to cut the ink supply slots 14, the final breakthrough being made by a wet etch. The final composite structure, FIG. 15, comprises a plurality of ink ejection chambers 18 disposed along each side of the slot 14 although, since FIG. 15 is a transverse cross-section, only one chamber 18 is seen on each side of the slot 14. Each chamber 18 contains a respective resistor 12 and an ink supply channel 20 extends from the slot 12 to each resistor 14. Finally, a respective ink ejection nozzle 38 leads from each ink ejection chamber 18 to the exposed outer surface of the layer 28. Thus it will be seen that the single ceramic layer 28 substitutes for both the barrier layer and the nozzle plate of the conventional printhead. Since the glass frit layer 22 forms less than 10% of the total height of the chamber 18, substantially the entire height of the chamber 18 is formed in the layer 28. This provides a very hard-wearing structure which is highly resistant to abrasive particles and aggressive solvents.

Figure 16:
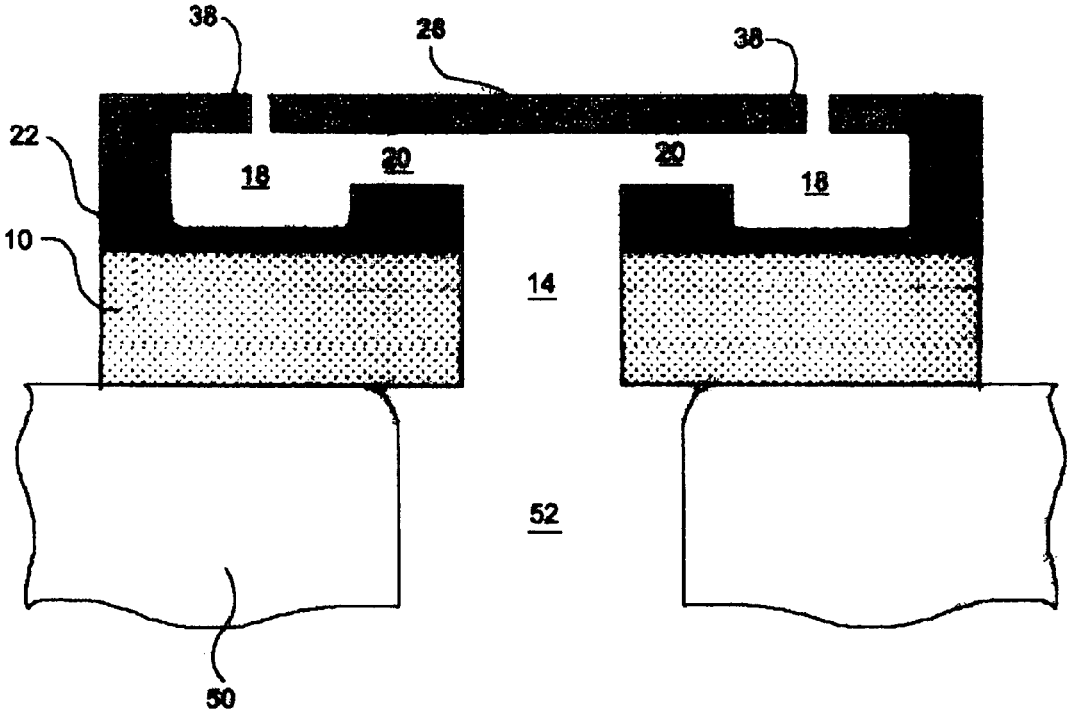
FIG. 16 is a cross-sectional view of a print cartridge incorporating the printhead of FIG. 15.

Finally, the wafer 10 processed as above is diced to separate the individual printheads from the wafer and each printhead die is mounted on a respective print cartridge body 50, FIG. 16, the body 50 having an aperture 52 for supplying ink from an ink reservoir (not shown) to the printhead in fluid communication with the slot 12 in the wafer 10.

In addition to their hardwearing characteristics, printheads made according to the foregoing embodiment are constructed from materials that have a close thermal coefficient of expansion (TCE) such that stresses are minimized when the printheads are operated at elevated temperatures. Thus, the materials used are silicon (whose TCE is 2.59 ppm per deg C.), glass frit (whose TCE can be engineered down to 5.0 ppm per deg C. or less) and silicon carbide (whose TCE is 4.8 ppm per deg C.).

Although in this embodiment the ceramic material used for the layer 28 is silicon carbide, alternative hard ceramic materials could be used such as silicon nitride (TCE=3.00 ppm per deg C.), yttria-modified zirconia (TCE=10.5 ppm per deg C.) or alumina (TCE=8.00 ppm per deg C.).

Alternatives to the fused glass frit layer 22 are also possible. The purpose of the layer 22 is to act as a planarization layer, i.e. to provide a hard flat surface above the level of the thin film inkjet circuitry to which the flat surface 28B of the ceramic layer 28 can be intimately bonded. For this purpose any suitable spin-on glass (SOG) planarization material can be used, for example, a silicate, phosphosilicate or siloxane SOG may be used. An alternative glass frit is Ferro Corporation EG 2805 (TCE=3.8 ppm per deg C.).

Figure 5:
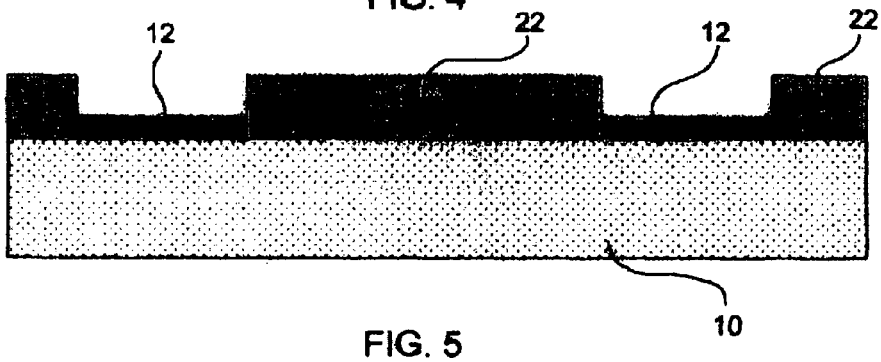
Figure 6:
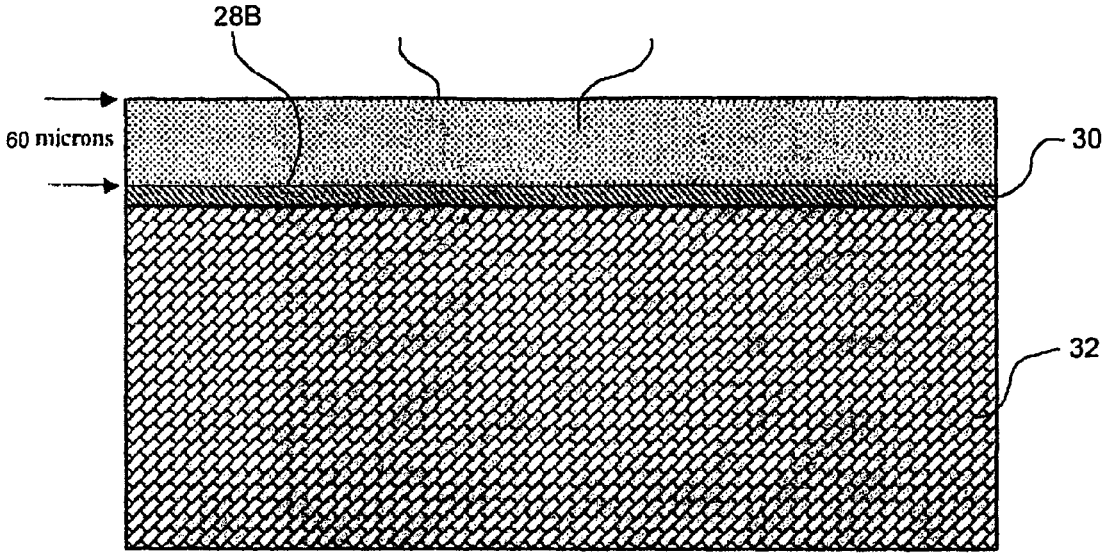
Figure 7:
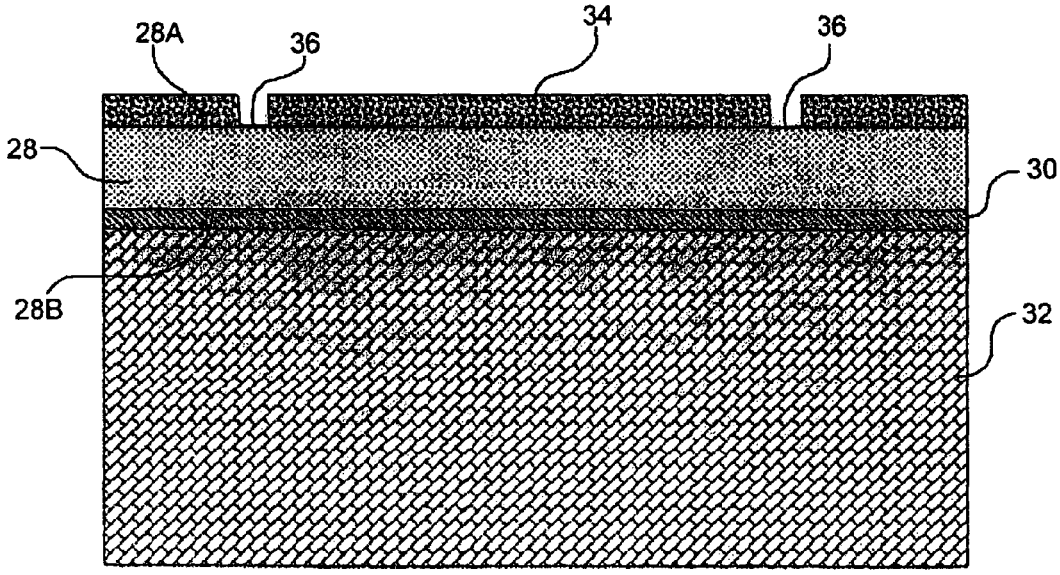
Figure 8:
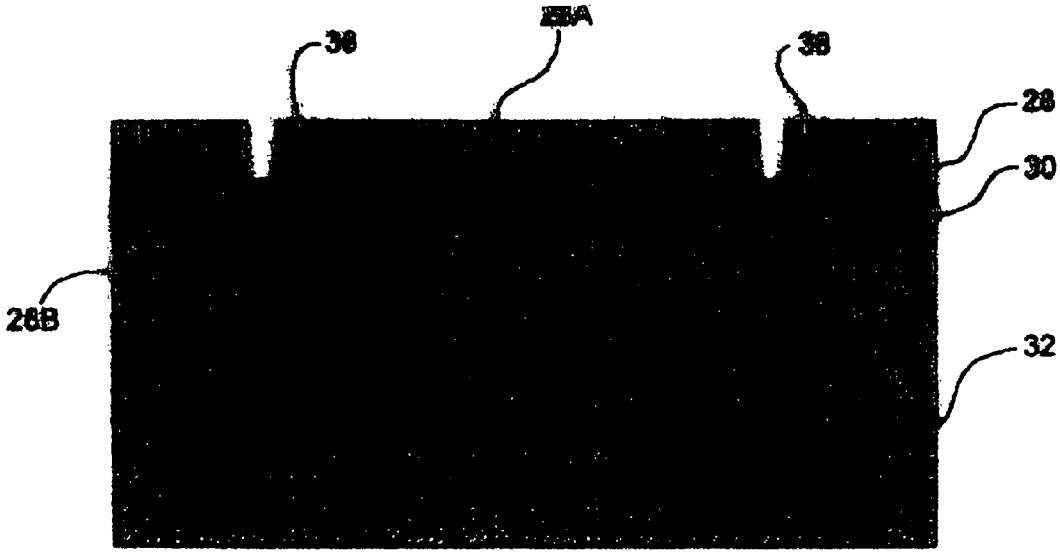
Figure 9:
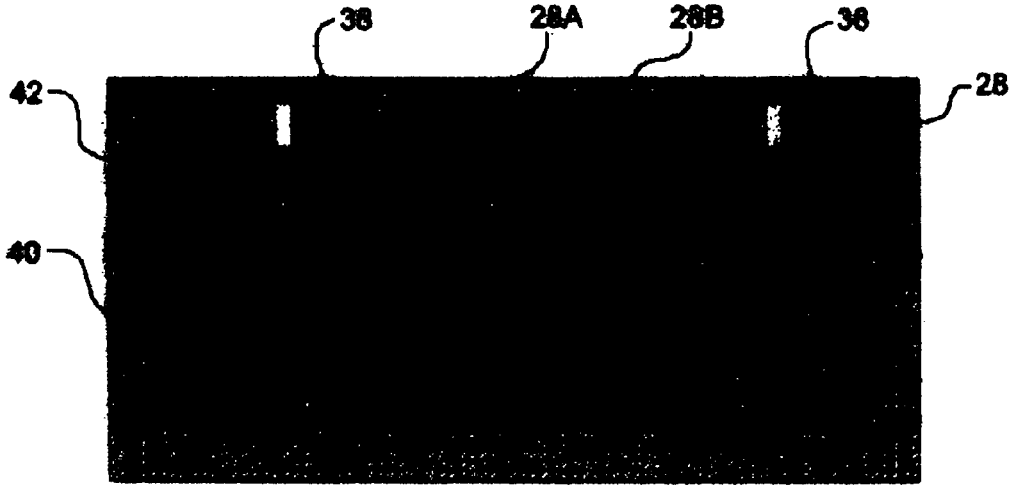

An alternative process to produce the structure of FIG. 5 is to mix the glass frit with a positive photoresist such as Shipley Microposit S1813 and to spin coat the mixture onto the wafer 10 to a thickness of about 10 microns to form the layer 22. The mixture is then baked at 125 deg C. for 5 minutes to evaporate off the solvents. The layer 22 is now selectivley exposed to UV through a photomask whose exposure windows correspond to and are aligned with the regions of the layer 22 corresponding to the openings 26 in FIG. 4, i.e. the same photomask is used as that used to expose the photoresist layer 24 in the process described above. The UV breaks down the photoresist in the mixture in the exposed regions and the mixture is then developed using a Shipley Microposit 351 developer. In this manner the glass frit mixture is removed from over the resistors 12. The wafer 10 is now heated to 250 deg C. to densify the glass frit before glazing at 390 deg C. The remaining surface of the layer 22 is now made smooth and flat by grinding and polishing again using, for example, a G&N Grind Polisher. Approximately 5 microns of glass frit is removed in the process to achieve substantially desired surface flatness. Debris left by the grinding process may be removed by any suitable cleaning process. The patterned and fused glass frit layer 22 is now ready to be bonded to the silicon carbide (or other ceramic) layer 28.

In general it is preferred that the TCE of each of the substrate 10, planarization layer 22 and ceramic layer 28 is 12 ppm per deg C. or less.

The invention is not limited to the embodiment described herein and may be modified or varied without departing from the scope of the invention.

What is claimed:

1. An inkjet printhead comprising a substrate, an ink ejection circuit on a surface of the substrate, a patterned planarization layer on the surface of the substrate, and a ceramic body having a substantially flat surface intimately bonded to the planarization layer, the ceramic body and planarization layer together defining at least one ink ejection chamber and associated ink ejection nozzle, with the nozzle and at least the major part of the height of the chamber formed in the ceramic body.

2. A printhead as claimed in claim 1, wherein the ceramic body is a monolithic layer.

3. A printhead as claimed in claim 1, wherein the ceramic body comprises silicon carbide, silicon nitride, yttria-modified zirconia, or alumina.

4. A printhead as claimed in claim 1, wherein the planarization layer comprises a spin-on glass.

5. A printhead as claimed in claim 4, wherein the planarization layer comprises a fused glass frit.

6. A printhead as claimed in claim 1, wherein the substrate is a semiconductor substrate.

7. A printhead as claimed in claim 6, wherein the substrate is a silicon substrate.

8. A printhead as claimed claim 1, wherein each of the substrate, planarization layer and ceramic body has a thermal coefficient of expansion of 12 ppm per deg C. or less.

9. An inkjet printhead made by a method comprising forming an ink ejection circuit on a surface of a substrate, forming a patterned planarization layer on the surface of the substrate, and intimately bonding a substantially flat surface of a ceramic body to the planarization layer, the ceramic body and planarization layer together defining at least one ink ejection chamber and associated ink ejection nozzle, with the nozzle and at least the major part of the height of the chamber formed in the ceramic body.

10. An inkjet printhead according to claim 9, wherein the ceramic body is formed by attaching one surface of a ceramic layer to a first temporary substrate, selectively etching an opposite surface of the ceramic layer to form at least one blind nozzle, attaching the opposite surface of the ceramic layer to a second temporary substrate, removing the first temporary substrate, and selectively etching the one surface of the ceramic layer to form at least one ink jet chamber communicating with the nozzle, the one surface being the surface which is intimately bonded to the planarization layer.

11. An inkjet printhead according to claim 9, wherein the printhead is one of a plurality of such printheads formed substantially simultaneously on the substrate, the method further comprising dividing the first substrate into individual printheads.

* * * * *

UNITED STATES PATENT AND TRADEMARK OFFICE

CERTIFICATE OF CORRECTION

PATENT NO. : 8,152,280 B2
APPLICATION NO. : 11/042166
DATED : April 10, 2012
INVENTOR(S) : Phil Keenan et al.

It is certified that error appears in the above-identified patent and that said Letters Patent is hereby corrected as shown below:

In column 7, line 20, in Claim 8, delete “claimed” and insert -- claimed in --, therefor.

Signed and Sealed this
Twenty-seventh Day of November, 2012

David J. Kappos

David J. Kappos
*Director of the United States Patent and Trademark Office*